US007195217B1

(12) United States Patent
Wadensten

(10) Patent No.: US 7,195,217 B1
(45) Date of Patent: Mar. 27, 2007

(54) BRACKET ASSEMBLY FOR REMOVABLE MOUNTING OF A VIBRATOR ONTO A RAILROAD CAR

(76) Inventor: Theodore S. Wadensten, P.O. Box 8, 75 Stillson Rd., Wyoming, RI (US) 02898

( * ) Notice: Subject to any disclaimer, the term of this patent is extended or adjusted under 35 U.S.C. 154(b) by 0 days.

(21) Appl. No.: 11/335,220

(22) Filed: Jan. 19, 2006

(51) Int. Cl.
*A47B 96/00* (2006.01)

(52) U.S. Cl. ..... 248/223.41; 248/225.11; 248/229.11; 248/560; 248/562; 248/563; 248/566; 248/567; 248/598; 267/140.11; 267/140.4; 267/141; 267/141.1; 414/375

(58) Field of Classification Search ..... 248/223.41, 248/560, 562, 563, 566, 567, 598, 229.11, 248/225.11; 267/140.11, 141, 141.1, 140.4; 414/375
See application file for complete search history.

(56) References Cited

U.S. PATENT DOCUMENTS 2,229,037 A 1/1941 Boldman
3,003,733 A * 10/1961 Peterson ..... 248/223.41
3,463,431 A * 8/1969 Matson ..... 248/222.14
5,439,314 A 8/1995 Wadensten
5,636,826 A * 6/1997 Nakagaki et al. ..... 248/562
5,672,027 A 9/1997 Wadensten
5,779,427 A * 7/1998 Heffinger ..... 414/375
5,833,205 A * 11/1998 Lindbeck ..... 248/671
6,058,588 A 5/2000 Wadensten
6,837,648 B1 1/2005 Wadensten

* cited by examiner

*Primary Examiner*—Carl D. Friedman
*Assistant Examiner*—Todd M. Epps
(74) *Attorney, Agent, or Firm*—Patrick J. Pinto

(57) ABSTRACT

A bracket assembly for a car shaker vibrator that includes a vibrator mounting member that is pivotally connected by a pivot pin, in a hinged or clevis arrangement, to a wedge member. The wedge member includes the male portion of a Gardner type bracket that is adapted for engaging a mating female portion that is mounted on a railroad car. The vibrator mounting member may be selectively rotated between a first position and a second position. The vibrator mounting member is retained at the first position by a locating pin during the emptying of a railroad car during the selective operation of the car shaker vibrator. The vibrator mounting member is retained at the second position by the locating pin when the dislodgement of the male portion from the female portion is desired together with the selective and subsequent operation the car shaker vibrator. An intermediate position may be provided between the first position and the second position and used when needed.

15 Claims, 5 Drawing Sheets

10
12
14
16
18
20
22
24
26
28
30a
30b
32a
32b
34a
34b
40
42
44
46
48
50
60
64
2
3
30a (30b)
34a (34b)

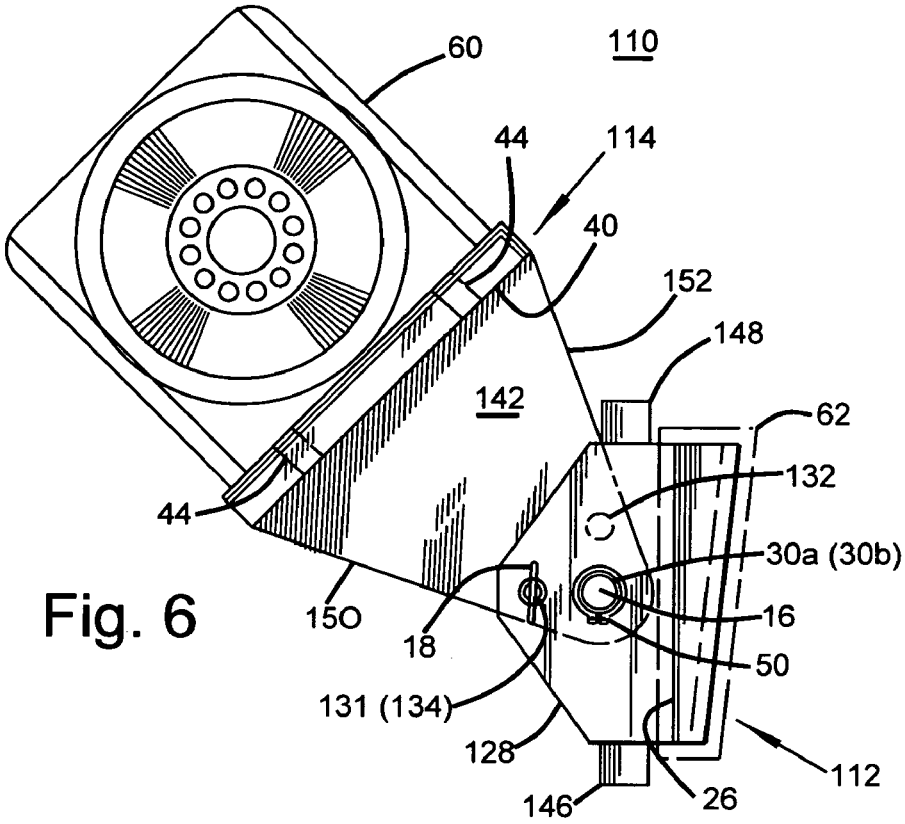
Fig. 6
Fig. 7
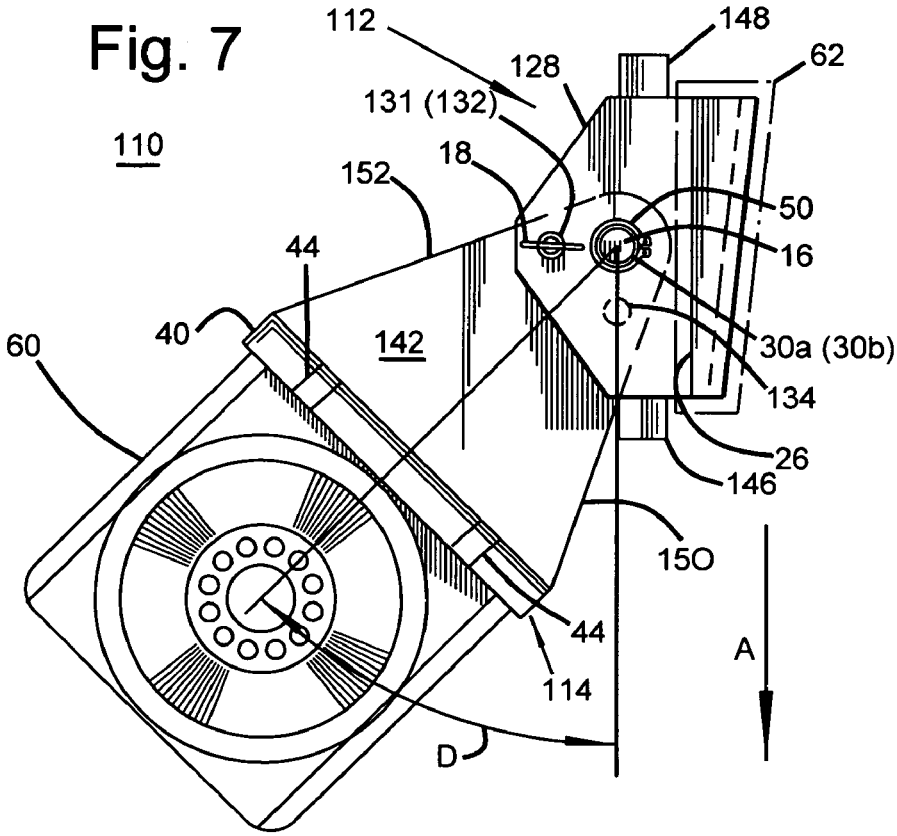

BRACKET ASSEMBLY FOR REMOVABLE MOUNTING OF A VIBRATOR ONTO A RAILROAD CAR

CROSS REFERENCE TO RELATED APPLICATION

Not Applicable

STATEMENT REGARDING FEDERALLY SPONSORED RESEARCH OR DEVELOPMENT

Not Applicable

BACKGROUND OF THE INVENTION

1. Field of the Invention

With regard to the classification of art, this invention is believed to be found in the general class for Supports and more particularly to those subclasses pertaining to the removable mounting of vibrators to a railroad car.

2. Description of Related Art

Detachable vibratory railroad car shaker apparatus are known in the field. Exemplary brackets and tools for the removable mounting of a vibrator to a railroad car are disclosed in U.S. Pat. No. 3,003,733 that issued to Petersen on Oct. 10, 1961; U.S. Pat. No. 3,463,431 that issued to Matson on Aug. 26, 1969; and U.S. Pat. No. 6,058,588 that issued to Wadensten on May 9, 2000. These patents disclose a common type of separable male/female bracket arrangement. Usually the female portion of the bracket is attached to a hopper portion of a railroad car. This type of bracket is sometimes referred to as a Gardner or Tyler type and generally has a C-shaped seat or pocket portion (i.e. a wedge, dovetail or the like.) The male portion generally may be characterized as a T-shape that has a blade member (i.e. male wedge, male dovetail or the like) and a reduced connector portion (i.e. web, neck, leg and the like). U.S. Pat. No. 3,003,733 also discloses a wedge shaped tool for separating the male portion from the female portion of the bracket. U.S. Pat. No. 5,779,427 that issued to Heffinger on Jul. 14, 1998 discloses a powered means for insertion and removal of the male portion or half of the bracket into the female portion or half of the bracket. U.S. Pat. No. 3,463,431 discloses a threaded means for retaining the male portion of the bracket in the female portion of the bracket. U.S. Pat. No. 6,058,588 that issued to the present inventor and is solely owned by him discloses a tool that may be employed for releasing the wedge from the female portion or half.

The pivotal mounting of vibrators for the directional control of plate or roller compactors is disclosed in U.S. Pat. No. 5,439,314 that issued on Aug. 8, 1995 and U.S. Pat. No. 5,672,027 that issued on Sep. 30, 1997; and U.S. Pat. No. 6,837,648 that issued on Jan. 4, 2005. Each of these patents issued to the present inventor and is solely owned by him and they are incorporated by reference into this disclosure.

As previously mentioned above, the female portion of the bracket is usually fixed to the railroad car by a suitable means such as welding and the like and therefore remains with the railroad car as it is moved to various yards, unloading sites or locations. Whereas, the vibrator and the male half of the bracket should remain at a particular site for unloading the railroad car. It can be appreciated that in use, the female portion of the bracket and the male portion may not be exactly mated because they come from different bracket manufacturers, car shaker manufactures and/or in fact one or both of the parts of the bracket may be worn or oxidized. It can be also appreciated that the vibrator action may in fact cause the male and female portions to further lock together. U.S. Pat. No. 2,229,037 that issued to Boldman on Jan. 21, 1941 recognized the problem and stated "the male portion and female portion may become so tightly wedged together as to bar removal by ordinary means and when it is desired to remove the vibrators, this must be done while they are energized". The above referenced patents have attempted to overcome the problem since the Boldman patent issued. However, it can be appreciated that trying to use a tool such as a wrench or hammer while the vibrator is energized becomes quite difficult.

Many times the male portion of the bracket is an integral part of the vibrator housing. It is common practice for a railroad work gang or crew to attempt to remove the vibrator from the car by means of a heavy hammer. It has been found that the railroad crews have accidentally damaged the vibrator housing or bent the wedge disclosed in U.S. Pat. No. 3,003,733. Thereby, rendering the equipment unusable for its intended use. If the crew is unsuccessful in removing the vibrator from the car, the vibrator will then travel with the railroad car to a new location. The work gang or crew may or may not have a spare vibrator to attach to another railroad car to be unloaded. The work gang may never see the vibrator again. Any permanent loss of the vibrator results in a loss of inventory and money. Permanent or temporary loss of a vibrator requires that spare vibrators be on hand thereby adding to operating costs.

It has been determined that there is still a need to provide a bracket assembly that is useable with various types of vibrators and combinations of male bracket portions and female bracket portions. This determination has been made from the inquiries that have been made to the present inventor by various end users. The desired bracket assembly must be easy to use and perform the function for which it has been designed without the need to use either impact tools, wrenches, extraction tools, and/or puller tools. The needed bracket assembly must operate in all weather conditions and in positions that have limited working space i.e. under a railroad car. The needed bracket assembly must also be economical to manufacture. The present invention provides such a bracket assembly and satisfies the identified need.

SUMMARY OF THE INVENTION

The present invention may be briefly described as: a bracket assembly for removable mounting of a vibrator onto a railroad car including: (a) a wedge member, a vibrator mounting member, a pivot pin, and a locating pin. The wedge member being shaped and sized for mating with a female bracket attached to a railroad car. The vibrator mounting member being pivotally attached to the wedge member by means of the pivot pin in a pivoted or hinged arrangement. The vibrator mounting member being selectively movable, in a clevis-like fashion, between at least a first or wedging position and a second or releasing position. The locating pin being sized for selective insertion into either a plurality of aligned first position or wedging position apertures in the wedge member and the vibrator mounting member for maintaining the first or wedging position. The locating pin being also sized and adapted for selective insertion into either a plurality of aligned second position or releasing position apertures in the wedge member and the vibrator mounting member in the second or releasing position. Wherein, the selective positioning and subsequent operation of the vibrator at the first or wedging position assists in the seating of the wedge member into the female bracket mounted on the railroad car for emptying the flowable material in the railroad car and selective positioning and operation of the vibrator at the second or releasing position dislodges the wedge member from the female bracket mounted on the railroad car for subsequent removal thereof.

The present invention may be used with various types of vibrators that are commonly used as car shakers whether they are operated either electrically, or pneumatically, or hydraulically. The present invention is particularly suited for use with high frequency pneumatic vibrators similar to the type disclosed in U.S. Pat. No. 6,261,059 that issued to the present inventor.

After the wedge member is seated, the present invention may also include a provision for placing and locating the vibrator at one or more operating angles that are intermediate the first position and the second position for variably increasing the amount of vibratory force that is applied upon the material in the interior of the hopper car.

In addition to the above summary, the following disclosure is intended to be detailed to insure adequacy and aid in the understanding of the invention. However, this disclosure, showing particular embodiments of the invention, is not intended to describe each new inventive concept that may arise. These specific embodiments have been chosen to show at least one preferred or best mode for a bracket assembly of the present invention. These specific embodiments, as shown in the accompanying drawings, may also include diagrammatic symbols for the purpose of illustration and understanding.

BRIEF DESCRIPTION OF THE DRAWING

FIG. 6 represents a side view of an alternate embodiment of the bracket assembly of the present invention. This view showing the alternate bracket assembly being located in a second or releasing position during its dislodgement from the female portion. The female portion is depicted in dashed outline.

FIG. 7 represents a side view of the alternate embodiment of the bracket assembly of the present invention. This view showing the alternate bracket assembly being located in a first or wedging position during its seating into the female portion. The female portion is depicted in dashed outline.

Figures 1, 2:
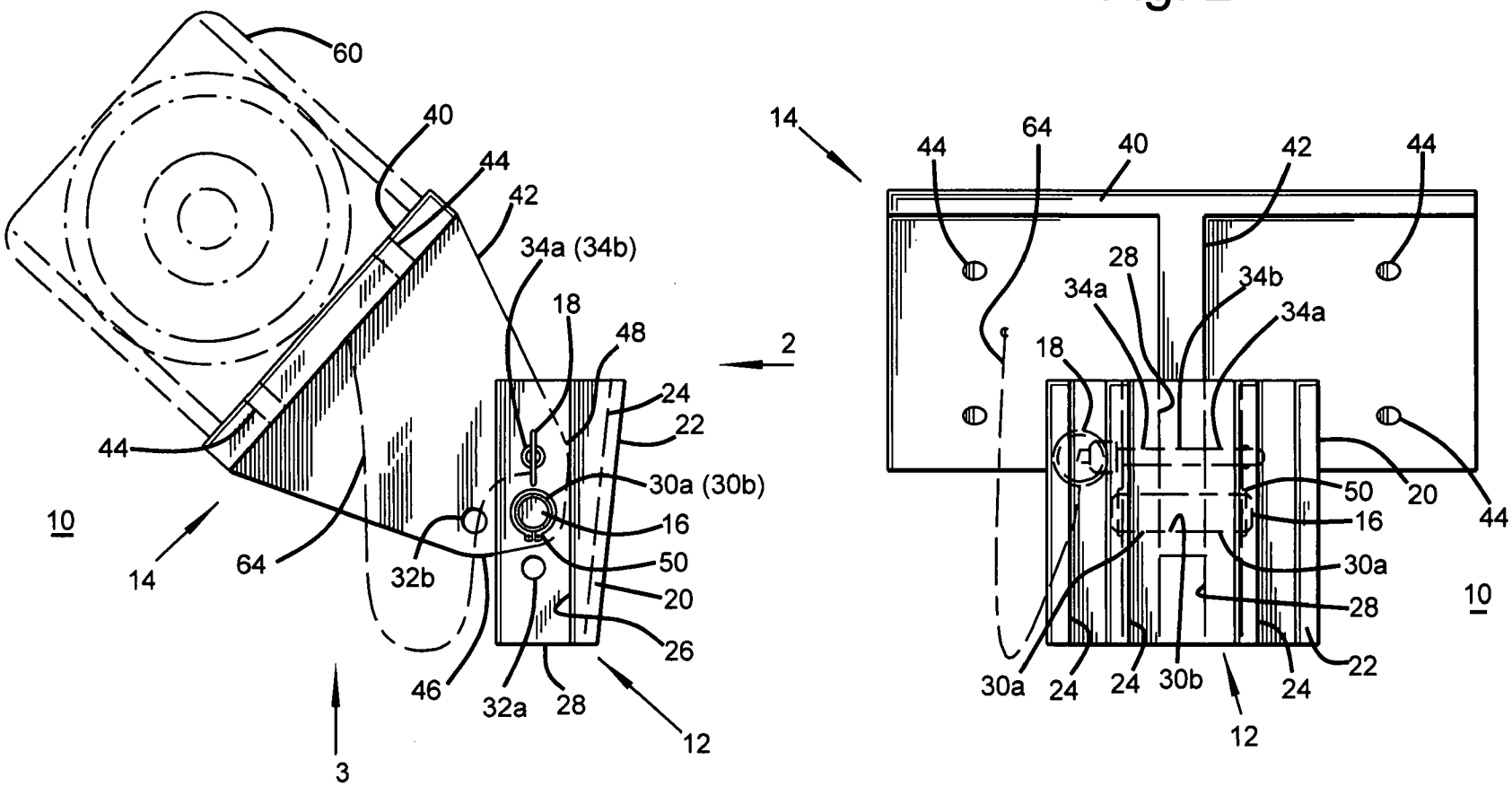
FIG. 1 represents a side elevation of a first embodiment of the bracket assembly of the present invention. A detachable vibrator is depicted in dashed outline.
FIG. 2 represents a rear elevation of the bracket assembly. This view is taken in the direction of arrow 2 in FIG. 1.

In the following description and in the appended claims, various details or components are identified by specific names for convenience. These names are intended to be generic in their application while differentiating between those various details or components. The corresponding reference numbers refer to like members throughout the several figures of the drawing.

The drawings accompanying and forming a part of this specification disclose details of construction for the sole purpose of explanation. It is to be understood that structural details may be modified without departing from the concept and principles of the invention as claimed. This invention may be incorporated into other structural forms than shown.

DETAILED DESCRIPTION OF THE FIRST EMBODIMENT

Figure 3:
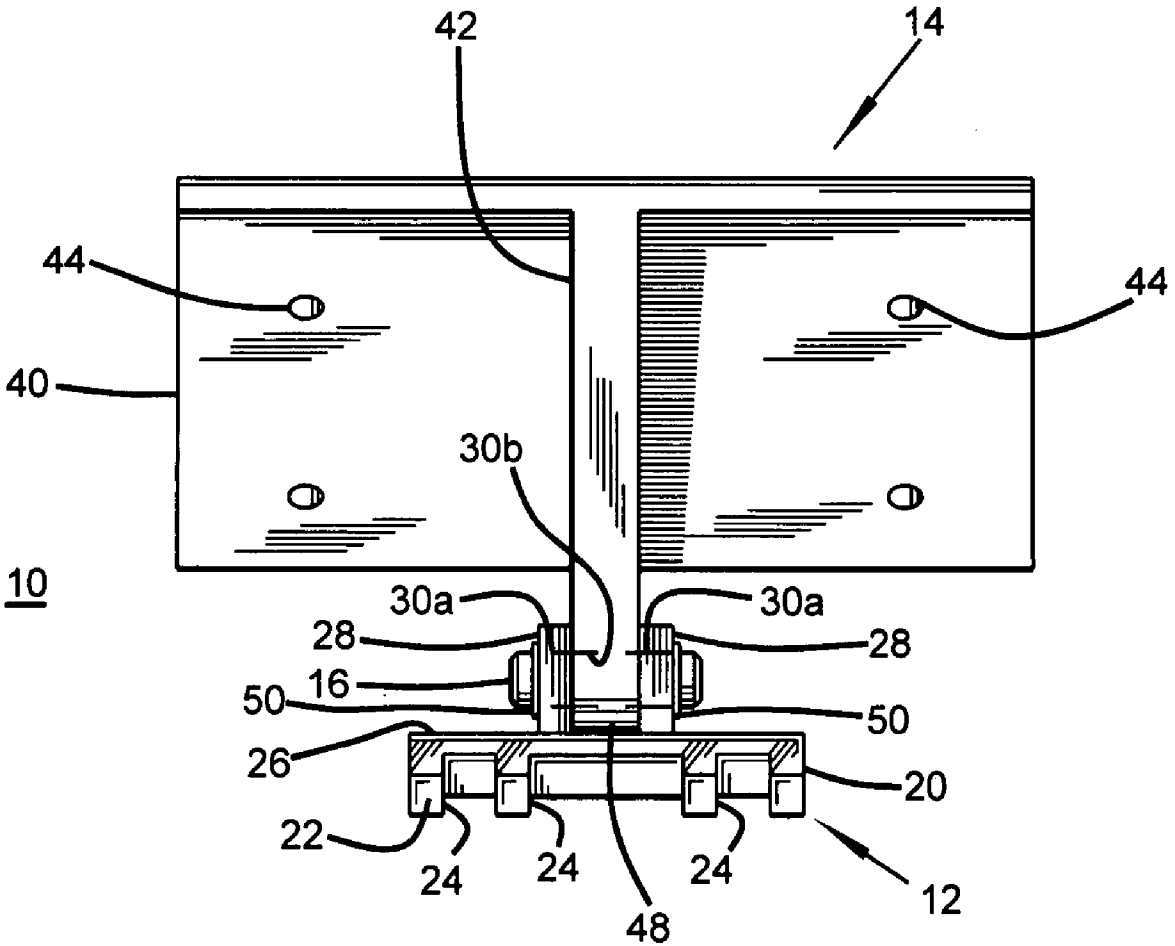
FIG. 3 represents a bottom elevation of the bracket assembly. This view is taken in the direction of arrow 3 in FIG. 1.

Referring first to FIGS. 1 through 3 of the drawings, a first embodiment of bracket assembly of the present invention is generally identified as 10. The bracket assembly 10 includes a wedge member 12, a vibrator mounting member 14, a pivot pin 16, and a locating pin 18.

The wedge member 12 includes a male portion 20 that is usually tapered. One non-limiting example of typical male portion 20 is a Gardner or Tyler type for railroad cars. A front or tapered face 22 may be either flat or include a plurality of channels 24 formed therein as shown. A rear face 26 of the male portion 20 has a pair of elongated lug members 28 or ears extending there from in a selectively spaced relationship. Each of the elongated lug members 28 includes a through pivot aperture 30*a* that is selectively formed therein to be in-line with each other and substantially parallel to the rear face 26. The pivot apertures 30*a* are sized for allowing the pivot pin 16 to pass there through. Each of the elongated lug members 28 also includes a wedging position locating aperture 32*a* and a releasing position locating aperture 34*a*. The wedging position locating apertures 32*a* are selectively sized and formed in-line so that the locating pin 18 may selectively reside therein and there through. Likewise the releasing position locating apertures 34*a* are selectively sized and formed in-line so that the locating pin 18 may selectively reside therein and there through.

The vibrator mounting member 14 is substantially T-shaped and includes a mounting plate 40 and a leg member 42 that extends perpendicularly therefrom. The mounting plate 40 includes a plurality of through apertures 44 that are sized and spaced to match the mounting holes for a car shaker vibrator 60 that will be removably mounted thereto and thereon. The thickness of the leg member 42 is sized to fit into the space between the lug members 28 while allowing the pivotal movement thereof. The leg member 42 includes a pivot aperture 30*b*, a wedging position aperture 32*b*, and a releasing position aperture 34*b*. The pivot aperture 30*b* is similar to pivot aperture 30*a* in size while allowing the pivotal movement. The wedging position aperture 32*b* and the releasing position aperture 34*b* are similar to apertures 32*a* and 34*a* respectively. The centers of the wedging position aperture 32*b* and the releasing position aperture 34*b* are placed on a bolt circle that is equal to the center to center distance between the pivot apertures 30*a* and apertures 32*a* and 34*a*. Preferably, the leg member 42 further includes a first stop member 46 and a second stop member 48. The first stop member 46 is shaped and sized for abutting the rear face or surface 26 of the male portion 20 of the wedge member 12 for aiding in the alignment of the wedging position apertures 32*a* and 32*b* prior to the selective insertion and subsequent retention of the locating pin 18 therein. The second stop member 48 is shaped and sized for abutting the rear face or surface 26 of the male portion 20 of the wedge member 12 for aiding in the alignment of the releasing position apertures 34*a* and 34*b* prior to the selective insertion and subsequent retention of the locating pin 18 therein. The pivot pin 16 should be retained in apertures 30*a* and 30*b* by at least one removable retainer 50 that will withstand the forces exerted during the operation of the vibrator. One non-limiting example of a removable retainer 50 is a heavy-duty type of retaining ring. Likewise the locating pin 18 should be of a type that will remain in place during the operation of the vibrator and be selectively removable absent the use of tools. One non-limiting example of a locating pin 18 suitable for this application is a commercially available ball detent pin that is operated by a suitable means such as depressing a button.

It is to be noted that the wedge member 12 may be fabricated as a weldment or molded of a suitable metal material. Likewise the vibrator mounting member 14 may be fabricated as a weldment or molded of a suitable metal material.

USE AND OPERATION OF THE FIRST EMBODIMENT

Figure 5:
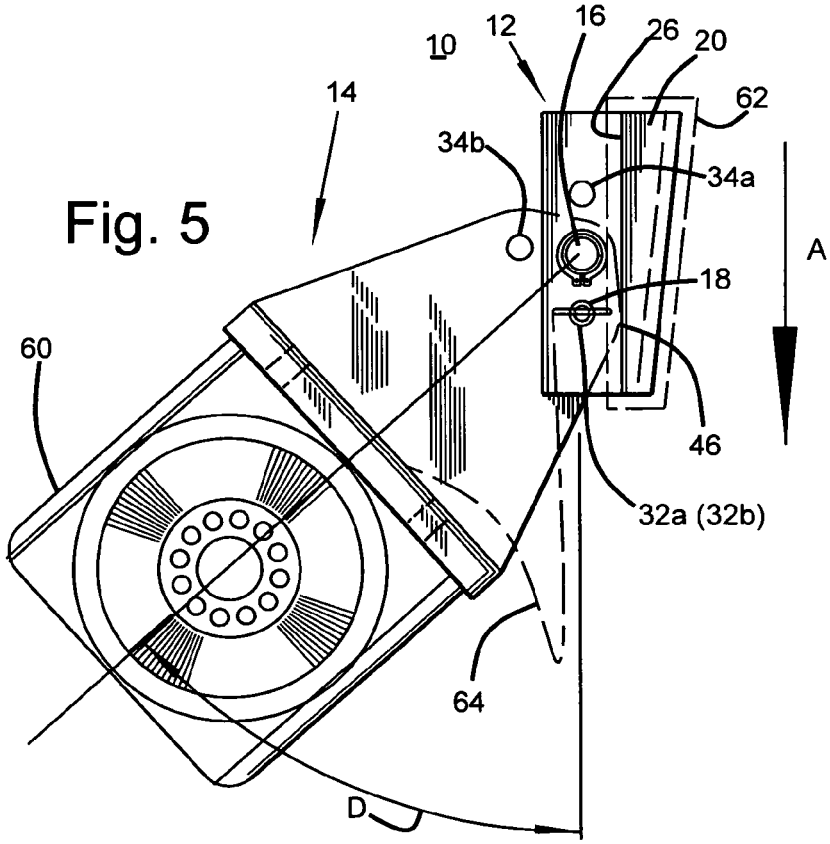
FIG. 5 represents a side elevation of the present invention. This view showing the bracket assembly of FIG. 4 after being located in the first or wedging position during the seating in the female portion. The female portion is depicted in dashed outline.

Referring in particular to FIG. 5, the bracket assembly 10 having a vibrator 60 mounted to the vibrator mounting member 14 is manually positioned into a female portion 62, shown in dashed outline, of the Gardner or Tyler mounting bracket that is attached to a wall or hopper of a railroad car (not shown). The bracket assembly 10 is retained in the first or wedging position by having the locating pin 18 fully inserted into the wedging position locating apertures 32*a* and the wedging position apertures 32*b*. During the subsequent energizing of the vibrator, the male portion 20 is further seated into the female portion 62 due to a component of the vibratory forces being generated in a downward direction, depicted by arrow A, and substantially parallel to the rear face 26. It is preferred that vibrator 60 be selectively positioned and operated within a total angular range between 0 degrees and 90 degrees that is identified as angle D and measured in a clockwise direction. The center of angle D is the center of pivot pin 16. A larger value of angle D will produce a greater force that will be directed towards the wall of the railroad car. Of course, it is to be understood that the location of the first stop member 46 and apertures 32*a* or 32*b* may need to be modified from the locations that are shown in the appended drawings when the angle D is changed from the midpoint of the total range as illustrated in the drawing.

Figure 4:
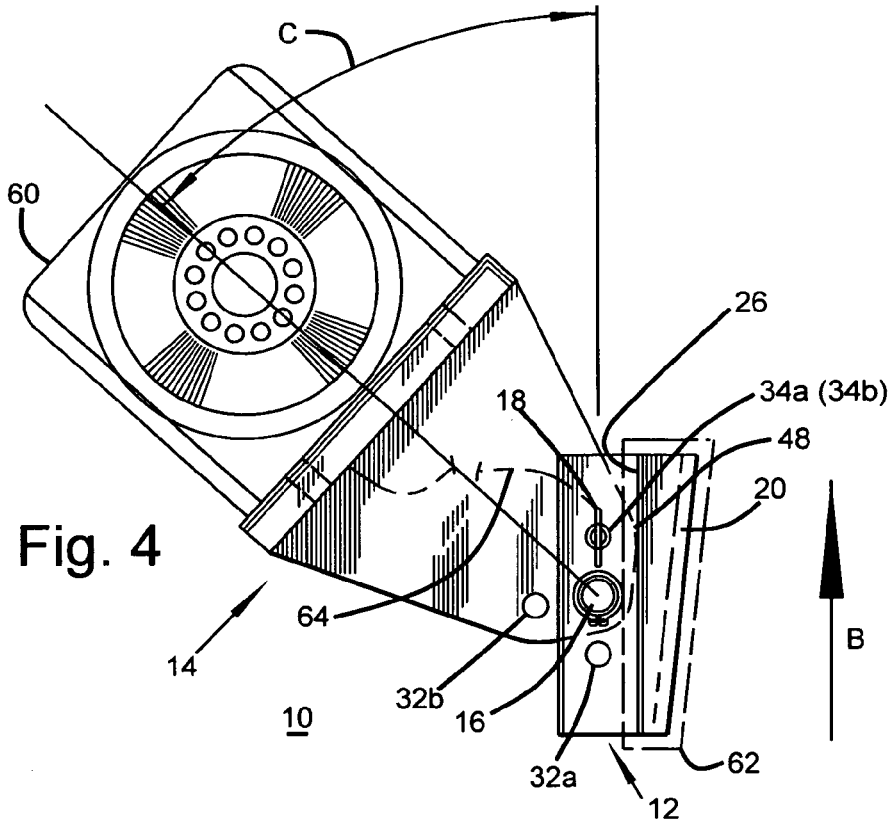
FIG. 4 represents a side elevation of the present invention. This view showing the first embodiment of the bracket assembly being located in the second or releasing position during its dislodgement from the female portion. The female portion is depicted in dashed outline.

Referring in particular to FIGS. 4 and 5, the procedure for removal of the bracket assembly 10 having the vibrator 60 mounted to the vibrator mounting member 14 and fully seated in the female portion 62 is as follows. First, the vibrator 60 is deactivated. Second, the locating pin 18 is removed from the wedging position locating apertures 32*a* and the wedging position apertures 32*b*. Third, the vibrator mounting member 14 and vibrator 60 are manually rotated in a clockwise direction so that the second stop member 48 abuts the rear face 26 as seen in FIG. 4. Fourth, the locating pin 18 is inserted into and through the aligned releasing position locating apertures 34*a* and releasing position apertures 34*b*. Fifth, the vibrator is actuated and generates vibratory forces. A component of the vibratory forces is applied in the general direction of arrow B which releases the male portion 20 from the female portion 62 allowing for the subsequent manual and complete removal of the male portion 20 from the female portion 62 by railroad personnel.

Referring in particular to FIG. 4, it is believed that the total possible operating range for the angle C for the releasing position of the vibrator bracket is between 0 degrees and 85 degrees and measured in a counterclockwise direction. The center for angle C is the same as for Angle D. The smaller value for angle C will provide the greatest releasing force in the direction of arrow B. Of course, the location of the second stop member 48 and apertures 34*a* or 34*b* may need to be modified from that shown in the appended drawings to accommodate changes to angle C other than the midpoint of the total range that has been illustrated in the drawing.

It is to be noted that it is preferred that the locating pin 18 be attached to the bracket assembly 10 by and with a flexible chain 64 or the like, seen in FIGS. 1, 2, 4, & 5. It is to be further noted that the leg member 42 may be integrally molded as part of a vibrator housing.

DESCRIPTION OF THE ALTERNATE EMBODIMENT

Figure 8:
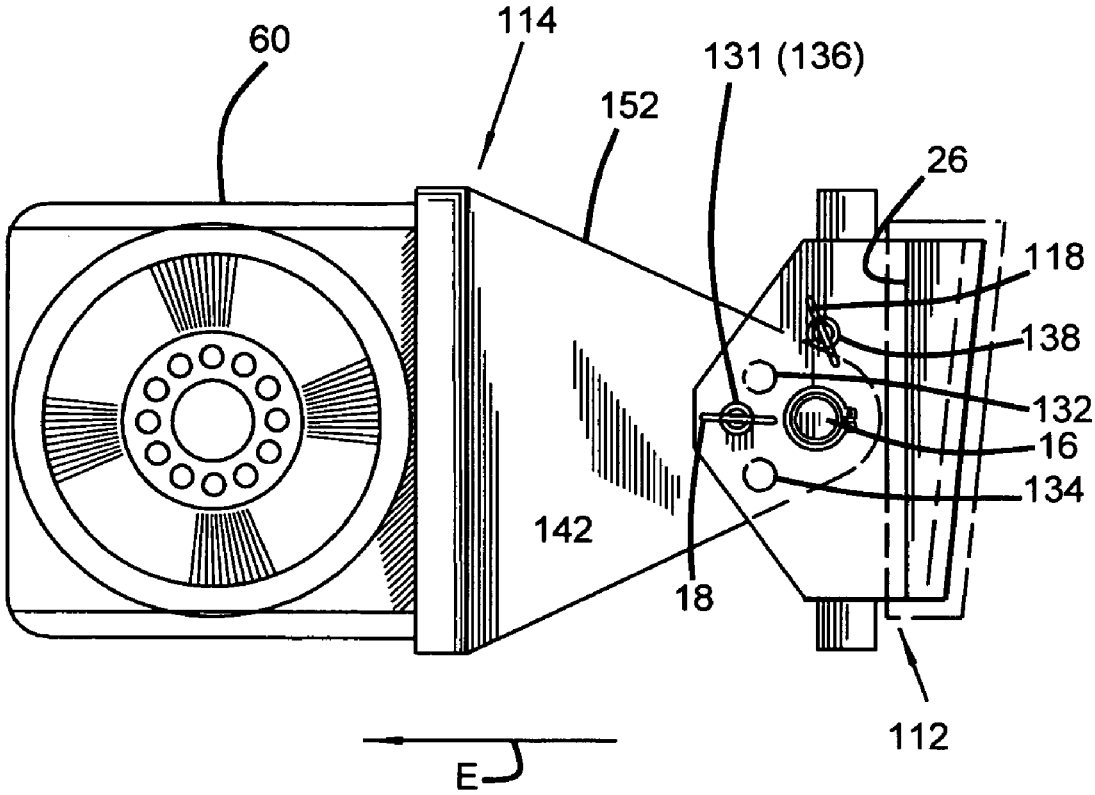
FIG. 8 represents a side view of the alternate embodiment. This view showing the bracket assembly being positioned and maintained at an operating position that is intermediate the first or wedging position and the second or releasing position.

Referring now in particular to FIGS. 6 through 8, an alternate embodiment for the bracket assembly of the present invention is generally identified as 110. The bracket assembly 110 includes a wedge member 112, a vibrator mounting member 114, a pivot pin 16, and a locating pin 18.

The wedge member 112 is similar to wedge member 12 described above and also includes a male portion 20. A rear face 26 of the male portion 20 has a pair of elongated lug members 128 or ears extending there from in a selectively spaced relationship. Each of the elongated lug members 128 includes a through pivot aperture 30*a* that is selectively formed therein to be in-line with each other and substantially parallel to the rear face 26. The pivot apertures 30*a* are sized for allowing the pivot pin 16 to pass there through. Each of the elongated lug members 128 also includes a locating aperture 131. The locating apertures 131 are selectively sized and formed in-line so that the locating pin 18 may selectively reside therein and there through.

The vibrator mounting member 114 is similar to vibrator mounting member 14 described above in connection with FIGS. 1–3. The vibrator mounting member 114 also is substantially T-shaped and also includes the mounting plate 40 and a leg member 142 that extends perpendicularly there from. The mounting plate 40 includes a plurality of through apertures 44 that are sized and spaced to match the mounting holes for a car shaker vibrator 60 that will be removably mounted thereto and thereon. The thickness of the leg member 142 is sized to fit into the space between the lug members 128 while allowing the pivotal movement thereof. The leg member 142 includes a pivot aperture 30*b*, a wedging or first position aperture 132, and a releasing or second position aperture 134. The pivot aperture 30*b* is similar to pivot aperture 30*a* in size. The wedging or first position aperture 132 and the releasing or second position aperture 134 are similar in size to apertures 131. The centers of the first position aperture 132 and the second position aperture 134 are placed on a bolt circle that is equal to the center to center distance between the pivot apertures 30*a* and apertures 131.

Preferably, the wedge member 112 further includes a first position stop member 146 and a second position stop member 148. The first stop member 146 is shaped, sized, and positioned for abutting a first edge 150 of the leg member 142 for aiding in the alignment of the locating position apertures 131 with the first position apertures 132 prior to the selective insertion and subsequent retention of the locating pin 18 therein. The second stop member 148 is shaped, sized, and positioned for abutting a second edge 152 of the leg member 142 for aiding in the alignment of the locating aperture 131 and the second position apertures 134 prior to the selective insertion and subsequent retention of the locating pin 18 therein. The pivot pin 16 should be retained in apertures 30*a* and 30*b* by at least one removable retainer 50 that will withstand the forces exerted during the operation of the vibrator. One non-limiting example of a suitable removable retainer 50 is a heavy-duty type of retaining ring. Likewise the locating pin 18 should be of a type that will remain in place during the operation of the vibrator and be selectively removable absent the use of tools. One non-limiting example of a locating pin 18 suitable for this application is a commercially available ball detent pin that is operated by a suitable means such as depressing a button.

Referring in particular to FIG. 8, it is anticipated that a vibrator 60 that is placed and operated at the first or wedging position in the lower portion of the total range of angle D may not provide enough vibrating force in the direction of arrow E to dislodge material in the railroad car that may not flow easily under adverse conditions. In this situation, the bracket assembly 110 may also include at least one intermediate position aperture 136 that is located in the leg member 142. Each intermediate position aperture 136 preferably is placed intermediate the first position aperture 132 and the second position aperture 134 and on their same bolt circle. It is preferred that all the intermediate position apertures 136 be similar in size to apertures 132 or 134. Preferably, the intermediate position, for the vibrator 60, as seen in FIG. 8 will only be used while the material level in the railroad car is above the level of the vibrator 60 for minimizing the possibility of developing cracks in the wall of the railroad car.

Still referring to FIG. 8, an optional intermediate position stop aperture 138 may be selectively positioned in either one or both of the elongated lug members 128 so that a removable stop pin 118 similar to pin 18 may be inserted therein for aiding in the aligning of locating aperture 131 with intermediate position aperture 136. This arrangement would allow the edge 152 to abut any stop pin 118 residing in apertures 138.

USE AND OPERATION OF THE ALTERNATE EMBODIMENT

Referring in particular to FIG. 7, the bracket assembly 110 having a vibrator 60 mounted to the vibrator mounting member 114 is manually positioned into a female portion 62, shown in dashed outline, of the Gardner or Tyler mounting bracket that is attached to a wall or hopper of a railroad car (not shown). The bracket assembly 110 is retained in the first or wedging position by having the locating pin 18 fully inserted into the wedging position locating apertures 131 and the wedging or first position aperture 132. During the subsequent energizing of the vibrator, the male portion 20 is further seated into the female portion 62 due to the component of the vibratory forces applied in a downward direction and is substantially parallel to the rear face 26 and depicted by arrow A. It is preferred that the vibrator 60 be selectively positioned and operated within an angular range between 0 degrees and 90 degrees that is identified as angle D. Angle D has been discussed above in connection with FIG. 5.

Referring in particular to FIG. 6, the procedure for removal of the bracket assembly 10 having the vibrator 60 mounted to the vibrator mounting member 114 and fully seated in the female portion 62 is as follows. First, the vibrator 60 is deactivated. Second, the locating pin 18 is removed from the first or wedging position locating apertures 131 and the wedging position aperture 132. Third, the vibrator mounting member 114 and vibrator 60 are manually rotated in a clockwise direction so that the second position stop member 148 abuts the second edge 152, subsequently the locating pin 18 is inserted into and through the aligned locating apertures 131 and releasing position apertures 134. Fourth, the vibrator is actuated and generates vibratory forces. A component of those vibratory forces is applied in the general direction of arrow B releasing the male portion 20 from the female portion 62 thereby allowing for the subsequent manual and complete removal of the male portion 20 from the female portion 62 by railroad personnel.

Referring still to FIG. 6, it is believed that that best angular range for the angle C for the releasing position of the vibrator bracket is between 0 degrees and 85 degrees. Angle C has also been discussed above in connection with FIG. 4.

Referring now to FIG. 8, the bracket assembly 110 may be positioned as illustrated and the vibrator 60 energized when material to be emptied from a railroad car (not shown) requires a greater vibratory force in the direction of arrow E. It is preferred that the vibrator 60 be moved to the first position after the level of the material is just above the level of the vibrator for final clean out of the railroad car.

It has been found that a front tip of the locating pin 18 need only be fully extracted from one aperture 131 in one lug member 128 and aperture 136 in leg member 42 before rotating the vibrator mounting member 114 from the first position to either the second position or an intermediate position or vice versa. This means that the end of the locating pin 18 may be left inserted in the other lug member 128 thereby reducing the time to fully insert the locating pin 18 into all the apertures 131 and 136.

It is preferred that the bracket assembly 110 be retained in the first position, as illustrated in FIG. 7, rather than the intermediate position shown in FIG. 8 during the final stages of emptying material from a railroad car and during clean out. This is to limit the amount and duration of excessive vibratory forces being exerted into the wall of a nearly empty railroad car for minimizing the creation of cracks in the railroad car wall.

As noted above, it is preferred that the locating pins 18 or 118 be attached to the bracket assembly 10 by and with a flexible chain 64 or the like for avoiding their loss. It is to be further noted that the leg member 42 may be integrally molded as part of a vibrator housing.

It is to be also noted that the present invention is believed to be suitable for use with all type of car shaker vibrators.

Directional terms such as "front", "back", "in", "out", downward, upper, lower and the like may have been used in the description. These terms are applicable to the embodiments shown and described in conjunction with the drawings. These terms are merely used for the purpose of description in connection with the drawings and do not necessarily apply to the position in which the present invention may be used.

While these particular embodiments of the present invention have been shown and described, it is to be understood that the invention is not limited thereto and protection is sought to the broadest extent that the prior art allows.

What is claimed is:

1. A bracket assembly for removable mounting of a vibrator onto a railroad car that includes:

(a) a wedge member, a vibrator mounting member, and a pivot pin; the wedge member being shaped and sized for mating with a female bracket attached to a railroad car;

(b) the vibrator mounting member being pivotally attached to the wedge member by means of the pivot pin in a hinge arrangement, the vibrator mounting member being selectively movable between at least a first position and a second position;

(c) at least one locating pin being sized for selective and removable insertion into at least one locating aperture of the wedge member and either of an aligned first position aperture in the vibrator mounting member for maintaining the vibrator mounting member at the first position or an aligned second position aperture in the vibrator mounting member for maintaining the vibrator mounting member at the second position, the vibrator mounting member further includes at least one intermediate position aperture that is positioned intermediate the first position aperture and the second position aperture for allowing the selective insertion of the locating pin therein for operation of the vibrator attached to the bracket assembly at a position intermediate the first position and the second position and;

(d) wherein the selective operation of the vibrator attached to the bracket assembly while being maintained at the first position assists in the seating of the wedge member into the female bracket mounted on the railroad car and selective operation of the vibrator attached to the bracket assembly while being maintained at the second position assists in the loosening of the wedge member from the female bracket mounted on the railroad car for its subsequent removal thereof.

2. A bracket assembly as recited in claim 1 wherein the vibrator mounting member is T-shaped and further includes a leg member, the leg member forming one half of the hinge arrangement and having the first position aperture and the second position aperture formed therein.

3. A bracket assembly as recited in claim 1 which further includes a first stop member, the first stop member being positioned and sized for aiding in the aligning of the first position aperture with each of the locating apertures prior to insertion of the locating pin.

4. A bracket assembly as recited in claim 3 which further includes a second stop member, the second stop member being positioned and sized for aiding in the aligning of the second position aperture with each of the locating apertures prior to insertion of the locating pin.

5. A bracket assembly as recited in claim 2 wherein the leg member further includes a first stop member, the first stop member being shaped and sized for abutting a rear surface of the wedge member for aiding in the aligning of the first position aperture with each of the locating apertures prior to insertion of the locating pin.

6. A bracket assembly as recited in claim 5 wherein the leg member further includes a second stop member, the second stop member being shaped and sized for abutting a rear surface of the wedge member for aiding in the aligning of the second position aperture with each of the locating apertures prior to insertion of the locating pin.

7. A bracket assembly for a removable mounting of a rotary vibrator to a railroad car that includes:

(a) a wedge member, a rotary vibrator mounting member, a pivot pin, and a locating pin; the wedge member being shaped and sized for mating with a female bracket attached to a railroad car;

(b) the rotary vibrator mounting member being pivotally attached to the wedge member by means of the pivot pin in a hinge arrangement, the rotary vibrator mounting member being selectively movable between a wedging position and a releasing position, the rotary vibrator mounting member further includes at least one intermediate position between the wedging position and the releasing position, (c) the locating pin being sized for selective inserting into either a plurality of aligned wedging position locating apertures in the wedge member and the wedging position aperture in the rotary vibrator mounting member for maintaining the wedging position or a plurality of aligned releasing position locating apertures in the wedge member and the releasing position aperture in the rotary vibrator mounting member in the releasing position or a plurality of aligned intermediate position locating apertures in the wedge member and one of the intermediate position apertures in the rotary vibrator mounting member, and;

(d) wherein the selective positioning and operation of the rotary vibrator carried by the bracket assembly while being maintained at the wedging position assists in the seating of the wedge member into the female bracket mounted on the railroad car and selective positioning and operation of the rotary vibrator carried by the bracket assembly while being maintained at the releasing position assists in the releasing of the wedge member from the female bracket mounted on the railroad car and its subsequent removal thereof and the selective positioning and operation of the rotary vibrator while being maintained at the intermediate position applies a greater vibratory force into the railroad car as and when required for dislodging material therein.

8. A bracket assembly as recited in claim 7 wherein the rotary vibrator is of a non-reversible type.

9. A bracket assembly as recited in claim 7 wherein the rotary vibrator mounting member includes a vibrator housing and a leg member integrally formed therewith, the leg member forming one half of the hinge arrangement.

10. A bracket assembly as recited in claim 9 wherein the wedge member further includes a first stop member, the first stop member being positioned and sized for abutting one surface of the leg member for aiding in the inserting of the locating pin into the wedging position locating apertures in the wedge member and the wedging position aperture in the vibrator mounting member.

11. A bracket assembly as recited in claim 10 wherein the wedge member further includes a second stop member, the second stop member being positioned and sized for abutting a second surface of the leg member for aiding in the inserting of the locating pin into the releasing position locating apertures in the wedge member and the releasing position aperture in the vibrator mounting member.

12. A bracket assembly as recited in claim 9 wherein the leg member further includes a first stop member, the first stop member being shaped and sized for abutting a rear surface of the wedge member for aiding in the inserting of the locating pin into the wedging position locating apertures in the wedge member and the wedging position aperture in the vibrator mounting member.

13. A bracket assembly as recited in claim 12 wherein the leg member further includes a second stop member, the second stop member being shaped and sized for abutting a rear surface of the wedge member for aiding in the inserting of the locating pin into the releasing position locating apertures in the wedge member and the releasing position aperture in the vibrator mounting member.

14. A bracket assembly as recited in claim 7 which further includes a first stop member, the first stop member being positioned and sized for aiding in the alignment of the wedging position locating apertures with the wedging position aperture for insertion of the locating pin there through.

15. A bracket assembly as recited in claim 14 which further includes a second stop member, the second stop member being positioned and sized for aiding in the alignment of the releasing position locating apertures with the releasing position aperture for insertion of the locating pin there through.

* * * * *